US005647443A

United States Patent [19]

Broeder

[11] Patent Number: 5,647,443

[45] Date of Patent: Jul. 15, 1997

[54] METHOD AND DEVICE FOR DRILLING FOR OIL OR GAS

[75] Inventor: René Broeder, Culemborg, Netherlands

[73] Assignee: Heerema Group Services B.V., Leiden, Netherlands

[21] Appl. No.: 504,352

[22] Filed: Jul. 19, 1995

[30] Foreign Application Priority Data

Jul. 22, 1994 [NL] Netherlands ..... 9401208

[51] Int. Cl.[6] ..... E21B 19/00

[52] U.S. Cl. ..... 175/5; 175/85; 166/359

[58] Field of Search ..... 175/5, 7, 85, 52; 414/22.51, 22.63, 22.68; 166/380, 382, 377, 359, 364, 350, 365, 367; 405/195.1, 201, 203

[56] References Cited

U.S. PATENT DOCUMENTS

| | | | |
|---|---|---|---|
| 3,895,677 | 7/1975 | Bokenkamp | 166/359 |
| 3,987,910 | 10/1976 | Brunato | 175/85 X |
| 4,081,087 | 3/1978 | Freeman, Sr. | 175/85 X |
| 4,117,941 | 10/1978 | McCleskey, Jr. et al. | 175/85 X |
| 4,208,158 | 6/1980 | Davies et al. | 175/85 X |
| 4,624,318 | 11/1986 | Aagaard | 166/359 |
| 4,735,267 | 4/1988 | Stevens | 166/350 X |

FOREIGN PATENT DOCUMENTS 0273474 6/1988 European Pat. Off. .

OTHER PUBLICATIONS

PCT Publication No. WO 87/07674 filed Dec. 17, 1987.

World Oil, vol. 203, No. 4, Oct. 1986, pp. 41–43, Houston, Texas, U.S.; R. W. Mowell, et al.; "New semi features better heave response, vertical riser storage" p. 42, figures 3,4.

*Primary Examiner*—William P. Neuder

*Attorney, Agent, or Firm*—Fulwider Patton Lee & Utecht, LLP

[57] ABSTRACT

In a method and device for drilling for oil or gas in an underwater bed by means of a drilling rig with a drilling derrick disposed on a floating drilling platform or on an underwater bed, prior to the placing of a casing string, the placing of a riser string or the drilling of a hole, one or more parts of the casing string, the riser string or the drill string are pre-assembled on the drilling rig at one or more pre-assembly points which are in a position which is different from the position of the drilling derrick.

24 Claims, 13 Drawing Sheets

METHOD AND DEVICE FOR DRILLING FOR OIL OR GAS

BACKGROUND OF THE INVENTION

This invention relates to a method and device for drilling for oil or gas in an underwater bed by means of a drilling rig disposed on a floating drilling platform or on the underwater bed.

DISCUSSION OF THE PRIOR ART

In conventional drilling rigs having a hoisting arrangement comprising at least one drilling derrick, a drilling crane, a crown block an a travelling block, oil or gas is drilled for by interconnecting drill pipes one by one at each drilling derrick to form a drill string, which is provided with a drill bit at the bottom end of a bottom-hole assembly, and by pressing the drill string into the underwater bed while it is being driven in a rotary manner. After a first hole with a relatively large diameter has been drilled in the bed in this way, the drill string is brought to the surface and taken apart for purposes of temporary storage. The drilled hole is subsequently consolidated by interconnecting casing pipes one by one and lowering the casing string thus formed into the drilled hole. The space between the casing string and the borehole wall is then filled up with cement, which sets and fixes the casing string in the bed.

A further borehole, of smaller diameter than the hole drilled earlier, is normally then made with the reassembled drill string through the positioned casing string, into which further borehole a casing is again inserted. This casing, which has a smaller diameter than the casing inserted earlier, is also formed by interconnecting casing pipes one by one to form a casing string.

Additionally, a further number of holes of ever decreasing diameter can be drilled, in which holes casings, likewise of decreasing diameter, are placed.

After one or two drillings from the above-described series of drillings, and after the insertion of the corresponding casing strings, a riser string, assembled by interconnecting riser pipes one by one, is inserted. The riser string forms the connection between the borehole in the underwater bed and the drilling rig, and a blow-out preventer is accommodated therein. In worsening weather conditions it may be necessary from the point of view of safety to bring the riser string temporarily to the surface, take it apart and store it at the drilling rig. As soon as weather conditions have improved sufficiently again, the riser string can be reassembled and inserted again.

A drawback of the method according to the prior art is that it takes a long time to complete the drilling, due to the assembly of the casing strings and the riser string from loose pipes. This assembly is carried out according to the prior art between two successive drillings and is thus an activity which lies in the critical path of activities for making the field to be drilled ready for production. The same applies to the assembly of the drill string, and in particular the assembly of the bottom-hole assembly of the drill string.

If a riser string needs to be brought to the surface and taken apart in a period of poor weather conditions and then reassembled and lowered when the weather conditions improve, the considerable time taken—of the order of days—is a drawback.

SUMMARY OF THE INVENTION

The object of the invention is to provide a method and device by means of which the time taken for completing a drilling can be reduced considerably, with the result that the costs of such a drilling decrease.

This object is attained by the method according to the invention wherein, prior to the placing of a casing string, the placing of a riser string or the drilling of a hole, one or more parts of the casing string, the riser string or the drill string are pre-assembled on the drilling rig at one or more pre-assembly points which are in a different position from the position of the at least one drilling derrick.

In this way one or more assembly points are created on the drilling rig, at which points a large number of preparatory activities can already be carried out during the time that the hoisting arrangement is in use, with the result that drilling according to the invention takes considerably less time than drilling according to the prior art.

Prior to the placing of a casing string or a riser string, it is preferable to interconnect a certain number of the pipes from which the above are assembled at a pre-assembly point to form a sub-assembly, and when the casing string or the riser string is being placed the sub-assembly is subsequently connected to one or more other pre-assembled sub-assemblies or pipes of a casing string or riser string. A bottom-hole assembly is also preferably pre-assembled at a pre-assembly point prior to the drilling of a hole, and during the drilling of the hole the bottomhole assembly is subsequently connected to pipes of the drill string. Many of the interconnections between casing pipes, riser pipes and/or drill string parts have thus already been made before the casing string, the riser string or the drill string is assembled in order to be placed. The interconnection of a number of casing pipes or riser pipes each time to form a sub-assembly can be carried out, for example, during the drilling activities of the drilling rig. The interconnection of a number of casing pipes each time can also be carried out, for example, during the assembly and placing of the riser string. The pre-assembly of a number of riser pipes each time can also be carried out, for example, during the assembly and placing of a casing string in the borehole, while it is also possible to pre-assemble a large part of the riser string prior to the placing thereof. Similarly, it is advantageous to pre-assemble sub-assemblies for a casing string during the placing of a riser string on the borehole. Yet another advantageous possibility is to pre-assemble the bottom-hole assembly for a drill string during the placing of a casing string or a riser string. In this way a part of the activities for assembling a casing or riser string is carried out simultaneously with other activities, instead of in succession, as normally occurs in the prior art. The parallel carrying out of the activities results in a considerable gain in time.

A sub-assembly for a casing string is preferably assembled in such a way that it comprises at least 3 and at most 10 casing pipes. The time required for assembling a complete casing string can be reduced by this measure to at most half of the originally required time, while the sub-assembly remains manoeuvrable.

In a further preferred embodiment a sub-assembly for a riser string comprises at least 3 and at most so many riser pipes that the length of the sub-assembly is 90% or more of the desired final length of the riser string. One thus pre-assembles a large number of assemblies of a limited number of riser pipes, or one pre-assembles one sub-assembly which constitutes a large part of the desired final length of the riser string, but which is still manoeuvrable in the drilling rig in order to move the sub-assembly above the borehole and place it thereon after the addition of a limited number of riser pipes.

In order to limit the number of sub-assembly manoeuvres as much as possible, the sub-assemblies for a casing string or a riser string are pre-assembled at the pre-assembly point preferably in vertical orientation. Following this, the sub-assemblies for a casing string or a riser string are stored in vertical orientation after pre-assembly and prior to the assembly and placing of the casing string or the riser string. For this purpose, in a preferred embodiment the sub-assemblies are supported in their lengthwise direction at least at two points in a rack.

A considerable gain in time can be achieved when bringing the riser string to the surface and taking it apart in a period of poor weather conditions, and reassembling and lowering it when weather conditions have improved, if according to the invention for its temporary removal a riser string which has been installed is divided into sub-assemblies, each consisting of a number of riser pipes, which sub-assemblies are tilted to a horizontal orientation for the storage thereof on the drilling rig. A special tilting support is used for the tilting, so that particularly rapid working can be achieved.

A device for carrying out the method according to the invention comprises a drilling rig disposed on a floating drilling platform or on the underwater bed, and having at least one drilling derrick; means for assembling a drill string and drilling a hole in the bed; means for assembling and placing a casing string in the borehole; and means for assembling and placing a riser string on the borehole; and is characterized by one or more pre-assembly installations which are situated in a place which is different from that of the at least one drilling derrick, for pre-assembling one or more parts of a casing, riser, or drill string, and conveyor means for conveying each part of a casing, riser or drill string from each pre-assembly installation to the means for assembling the casing, riser or drill string and placing the casing string in the borehole, placing the riser string on the borehole or drilling a borehole.

If a large number of sub-assemblies are pre-assembled by means of a pre-assembly installation, according to the invention sub-assembly storage means are provided for temporary storage of the sub-assemblies.

In a preferred embodiment the sub-assembly storage means comprise at least one rack comprising sets of arms situated above one another, the bottom set of arms being movable in the vertical direction relative to the top set of arms. When sub-assemblies are being pre-assembled, in the case of relatively short sub-assemblies the bottom set of arms can be moved to a short distance from the top set of arms, while in the case of relatively long sub-assemblies the bottom arms can be moved to a greater distance from the top arms, with the result that the required stability of fixing of the sub-assemblies is ensured.

The conveyor means of the drilling rig expediently consist of a hoisting crane, but they can also consist of a conveyor which is movable along guide rails and is provided with means for fixing a part of a casing, riser or drill string.

According to the invention, the means for connecting a sub-assembly to one or more other pre-assembled sub-assemblies or pipes of a casing string or riser string comprise a supporting structure disposed at a side of the at least one drilling derrick, the latter being movable sideways for placing of the supporting structure above an auxiliary working floor, which auxiliary working floor is provided with casing pipe and/or riser pipe connection means. In particular, the supporting structure comprises a number of V-shaped supports lying above one another, and each extending in a horizontal plane, the two legs of which supports face away from the drilling derrick, for the purpose of supporting a sub-assembly at different levels at two sides. The sub-assembly in vertical orientation is simple to place in the horizontal direction against the supports, for example by means of a hoisting crane, following which the bottom end of the sub-assembly on the auxiliary working floor is connected to an already assembled part of a casing or riser string.

The claim and advantages will be more readily appreciated as the same becomes better understood by reference to the following detailed description and considered in connection with the accompanying drawings in which like reference symbols designate like parts.

DESCRIPTION OF THE PREFERRED EMBODIMENTS

Figure 1:
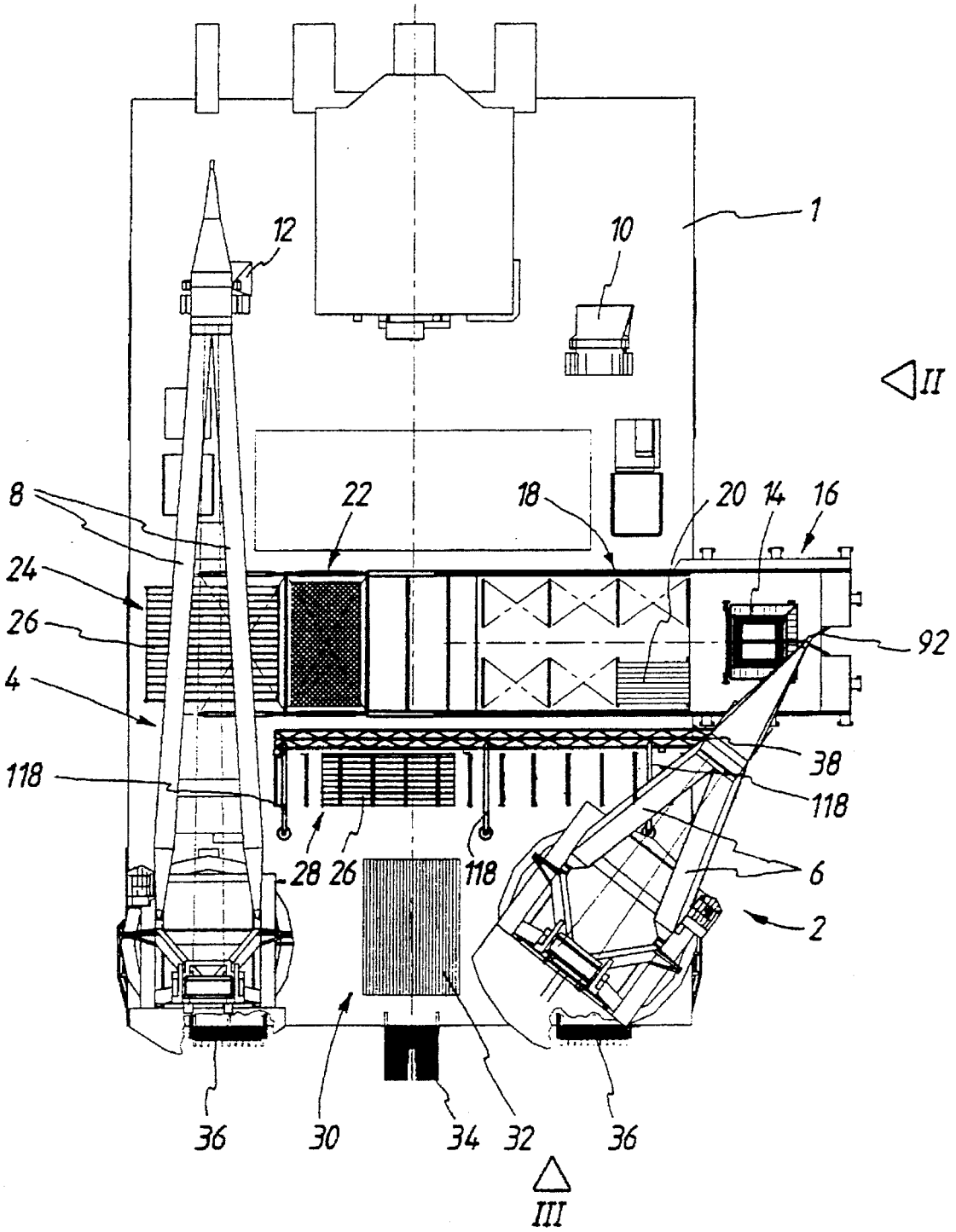
FIG. 1 shows a top view of a drilling rig on a floating drilling platform.
Figure 2:
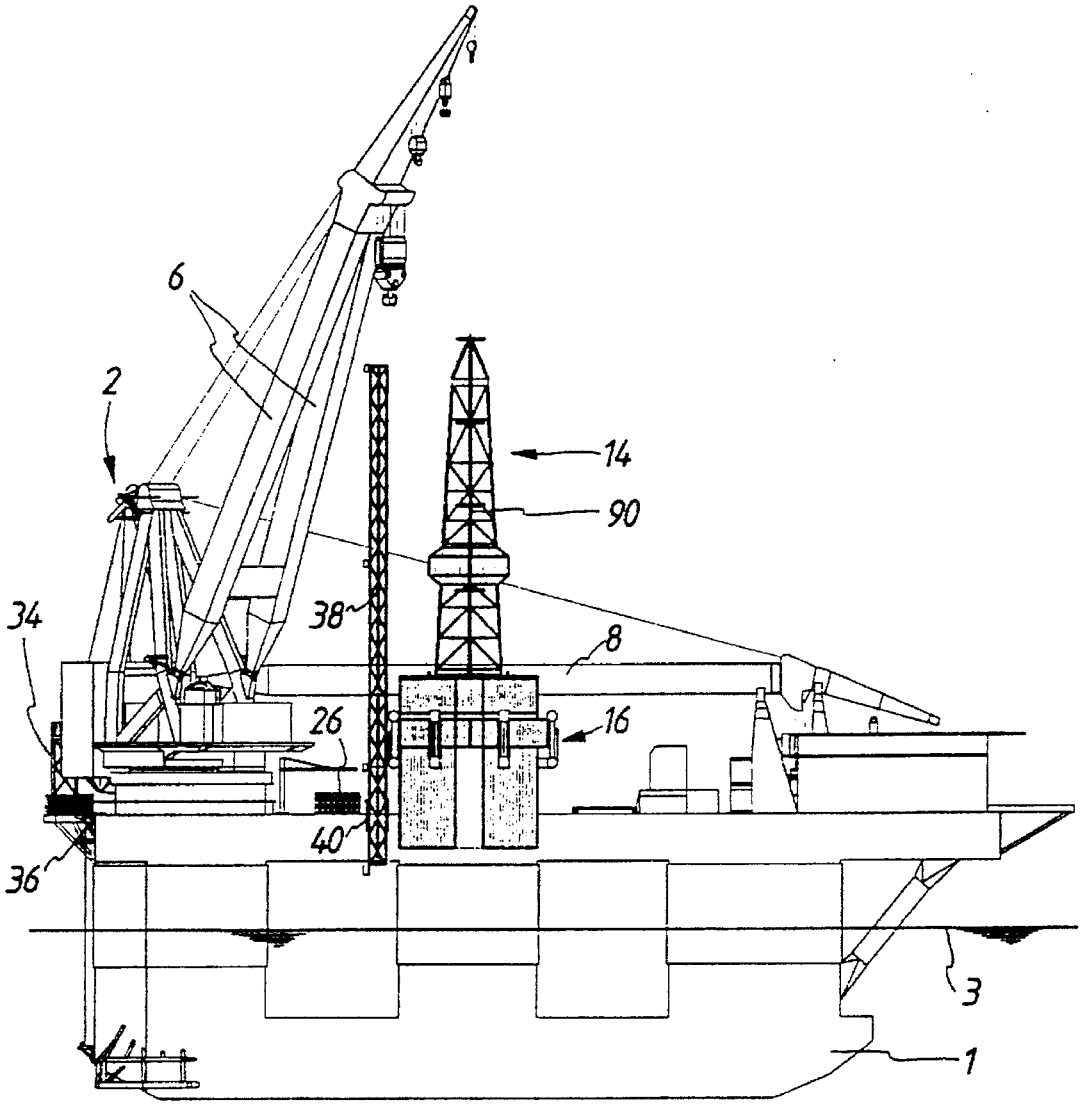
FIG. 2 shows a side view of the drilling rig and the drilling platform of FIG. 1 in the direction of arrow II.
Figure 3:
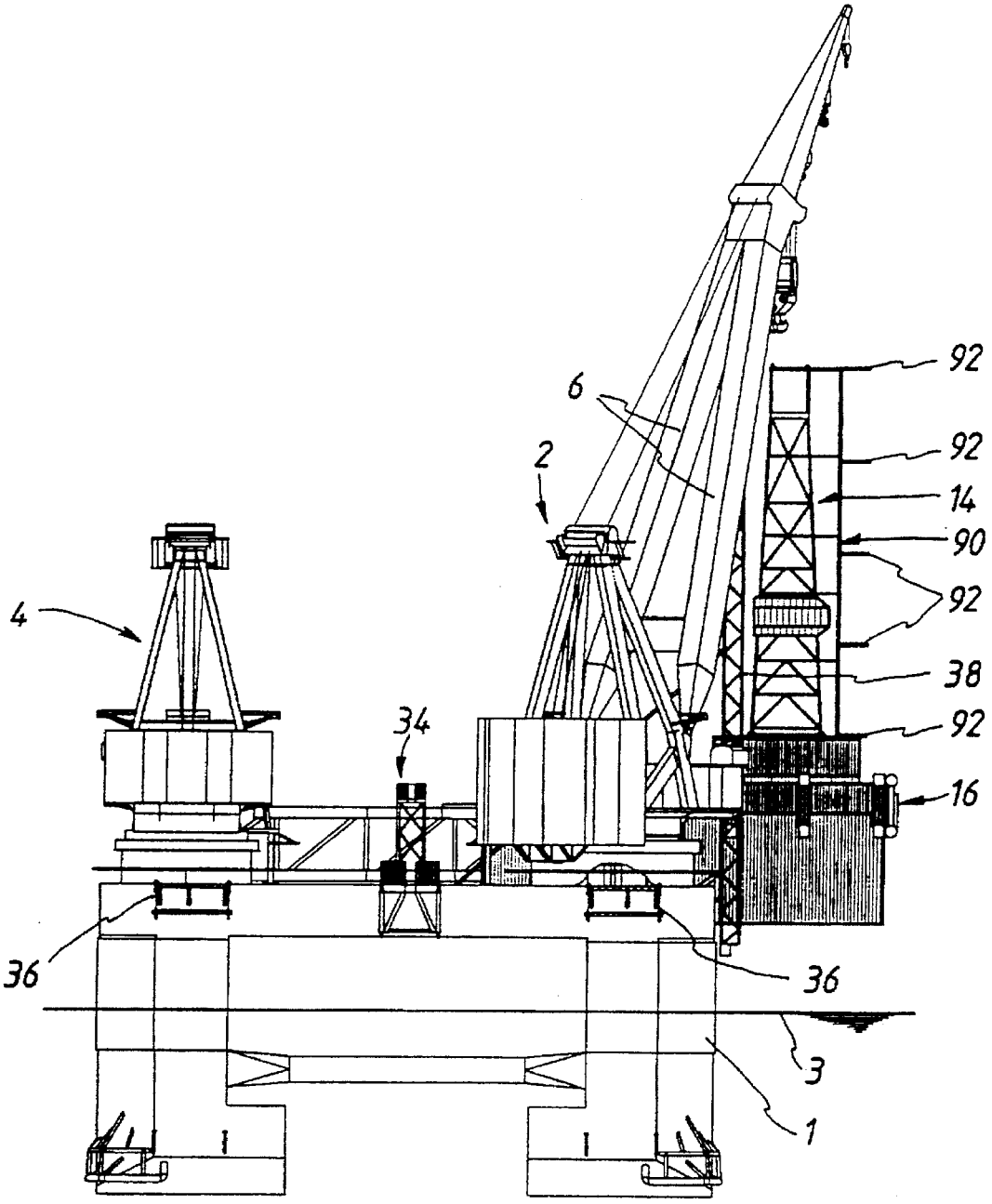
FIG. 3 shows a rear view of the drilling rig and the drilling platform of FIG. 1 in the direction of arrow III.
Figure 7:
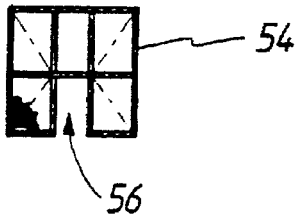
FIG. 7 shows a top view of another deck of the device of FIG. 4.
Figure 6:
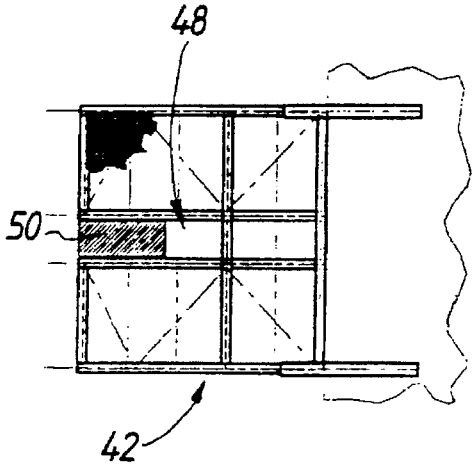
FIG. 6 shows a top view of a deck of the device of FIG. 4.
Figure 4:
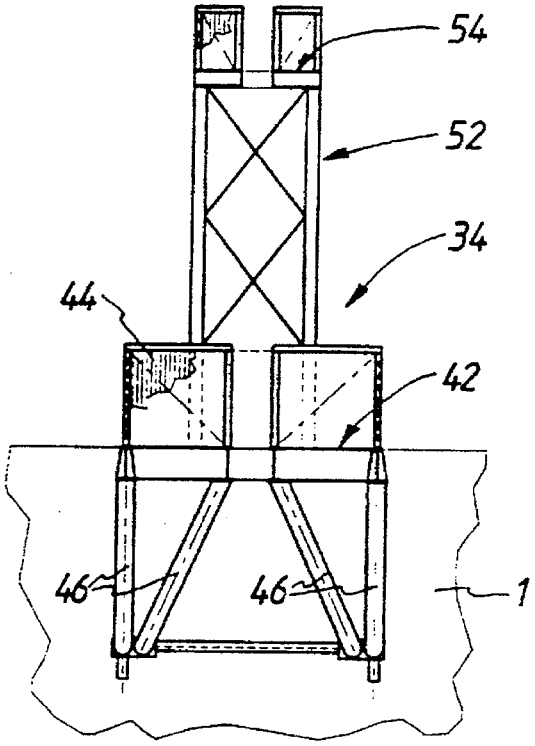
FIG. 4 shows a diagrammatic front view of a device for producing a sub-assembly of a casing string or a riser string.
Figure 5:
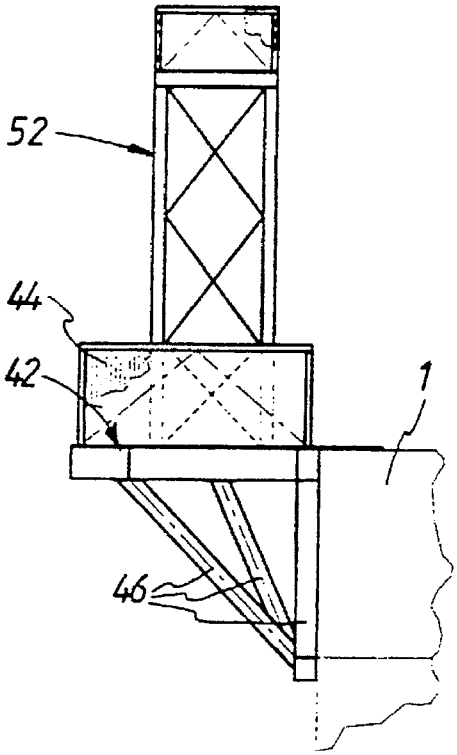
FIG. 5 shows a side view of the device of FIG. 4.

FIGS. 1–3 show a drilling platform 1 floating in water of a level 3, on which drilling platform two hoisting cranes 2 and 4 are placed near the rear end. The hoisting cranes 2 and 4 have tilting lifting arms 6 and 8 respectively and are rotatable about a vertical axis. The deck of the drilling platform is provided with two trestles 10 and 12 for bearing the lifting arms 6 and 8 respectively when the hoisting cranes 2 and 4 are not in operation. The drilling platform 1 is provided at the weather side with a drilling derrick 14 on a deck structure 16, which will be reverted to later with reference to FIGS. 11–13. A storage area 18 is provided near the drilling derrick 14, for storing drill pipes 20 in racks. Blow-out preventers are stored, and there is a workshop, in the area indicated by 22. Riser pipes 26 are stored in the area indicated by 24 and in the area indicated by 28. Casing pipes 32 are stored in the area indicated by 30. At the rear end of the drilling platform 1 there is a sub-assembly pre-assembly installation 34, next to which racks 36 for the storage of sub-assemblies of casing pipes and riser pipes are disposed. The drilling platform 1 also has a support 38, which is shown in the horizontal position in FIG. 1 and in the vertical position in FIG. 2, and which tilts about an axis 40.

FIGS. 4–7 show the sub-assembly pre-assembly installation 34 in greater detail. A deck 42 is formed, which deck is provided along the greater part of its edges with an upright wall 44 of sheet material. The deck 42 is supported at its underside by a number of supports 46, which are connected to the rear end of the drilling platform 1. A rectangular recess 48, which can be partially covered by a plate 50, is disposed in the deck 42. A structure 52 is disposed on the deck 42, which structure is provided at the top side with a deck 54 which, like deck 42, is provided with a rectangular recess, which is indicated by 56 in FIG. 7.

Figure 8:
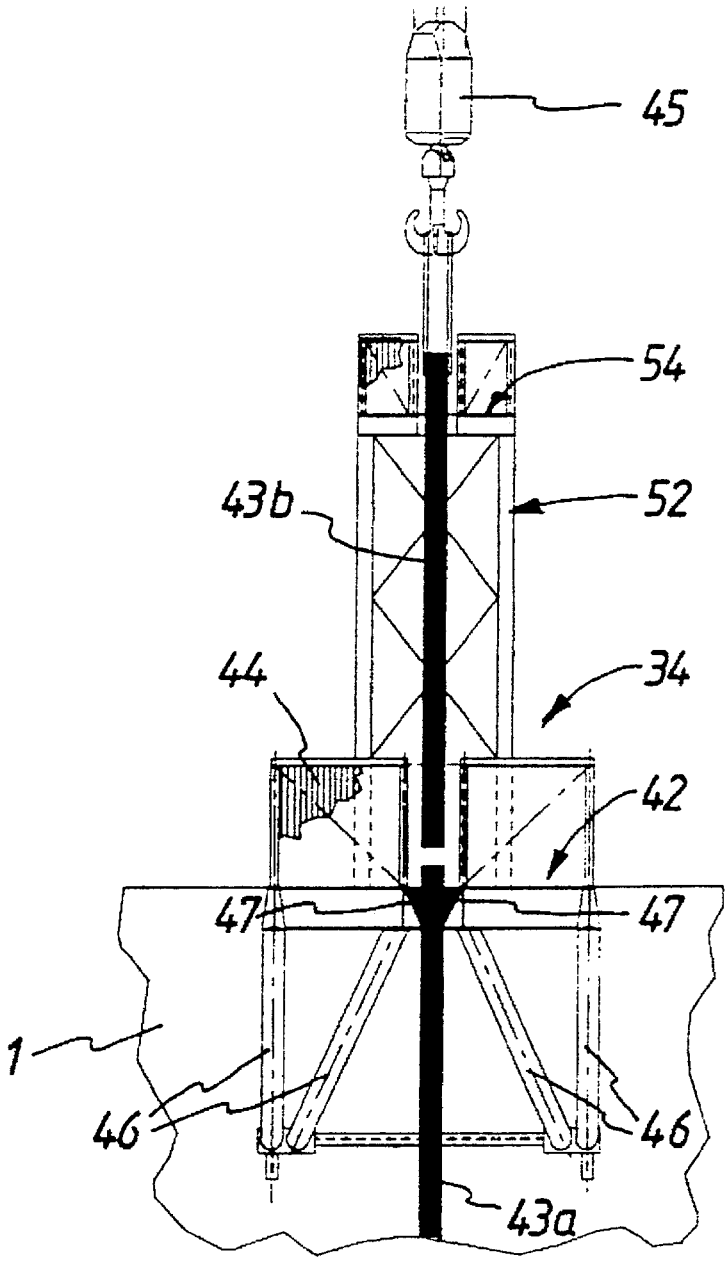
FIG. 8 shows the device of FIG. 4, in order to illustrate the production of a sub-assembly of a casing or a riser string.

As FIG. 8 illustrates, for the pre-assembly of a sub-assembly of a casing string or a riser string a pipe 43*a*, hanging in vertical orientation from a hook 45 of the crane 2 or the crane 4, is inserted into the recess 48 of the deck 42 and fixed by means of wedge-shaped claws 47 near the top end thereof. A further pipe 43*b*, hanging in vertical orientation from the hook 45, is then inserted into the recess 56 of the deck 54 in line with the fixed pipe 43*a*. The pipe 43*b* is subsequently lowered and connected to the pipe 43*a*. As soon as the connection is made, the claws 47 are released and the sub-assembly of pipes 43*a* and 43*b* is lowered until the top end of the pipe 43*b* is situated at the level of the deck 42. The pipe 43*b* is then fixed by means of the claws 47. One or more pipes can subsequently be added to the sub-assembly of pipes 43*a* and 43*b* in the manner stated above, until the desired length of the sub-assembly has been reached.

Figure 9:
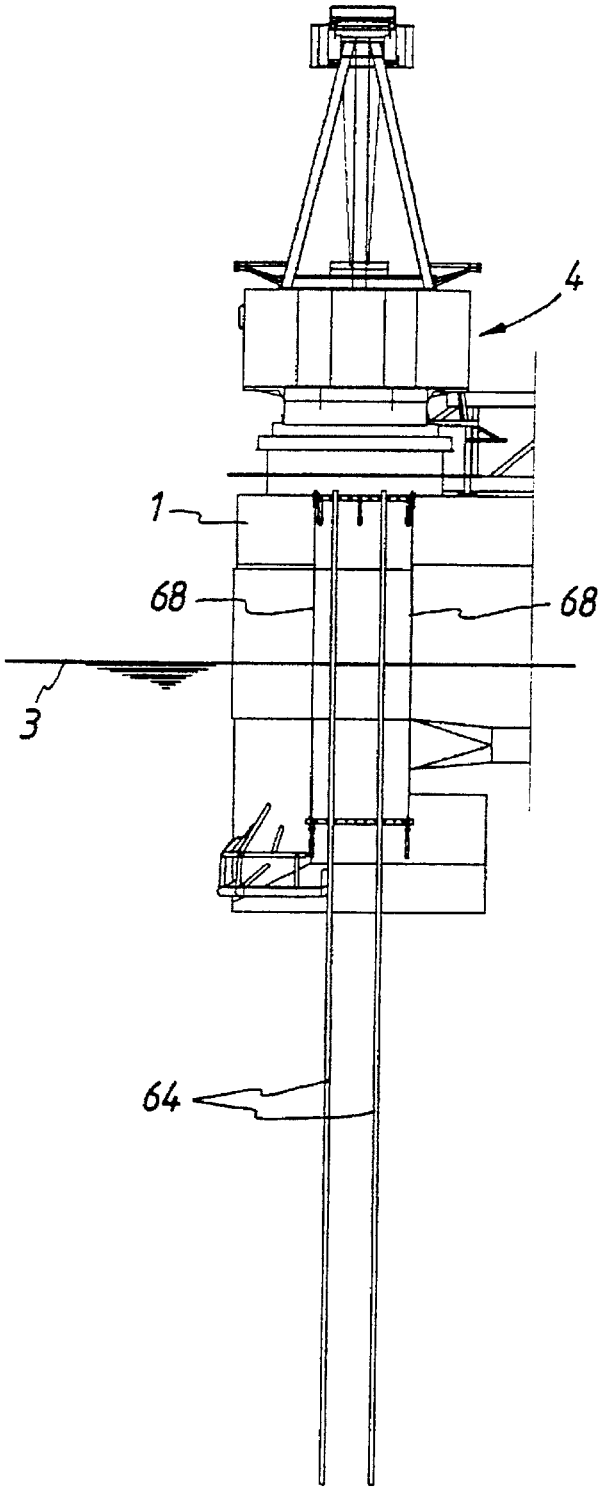
FIG. 9 shows a front view of a device for storing sub-assemblies of a casing string or a riser string.
Figure 10:
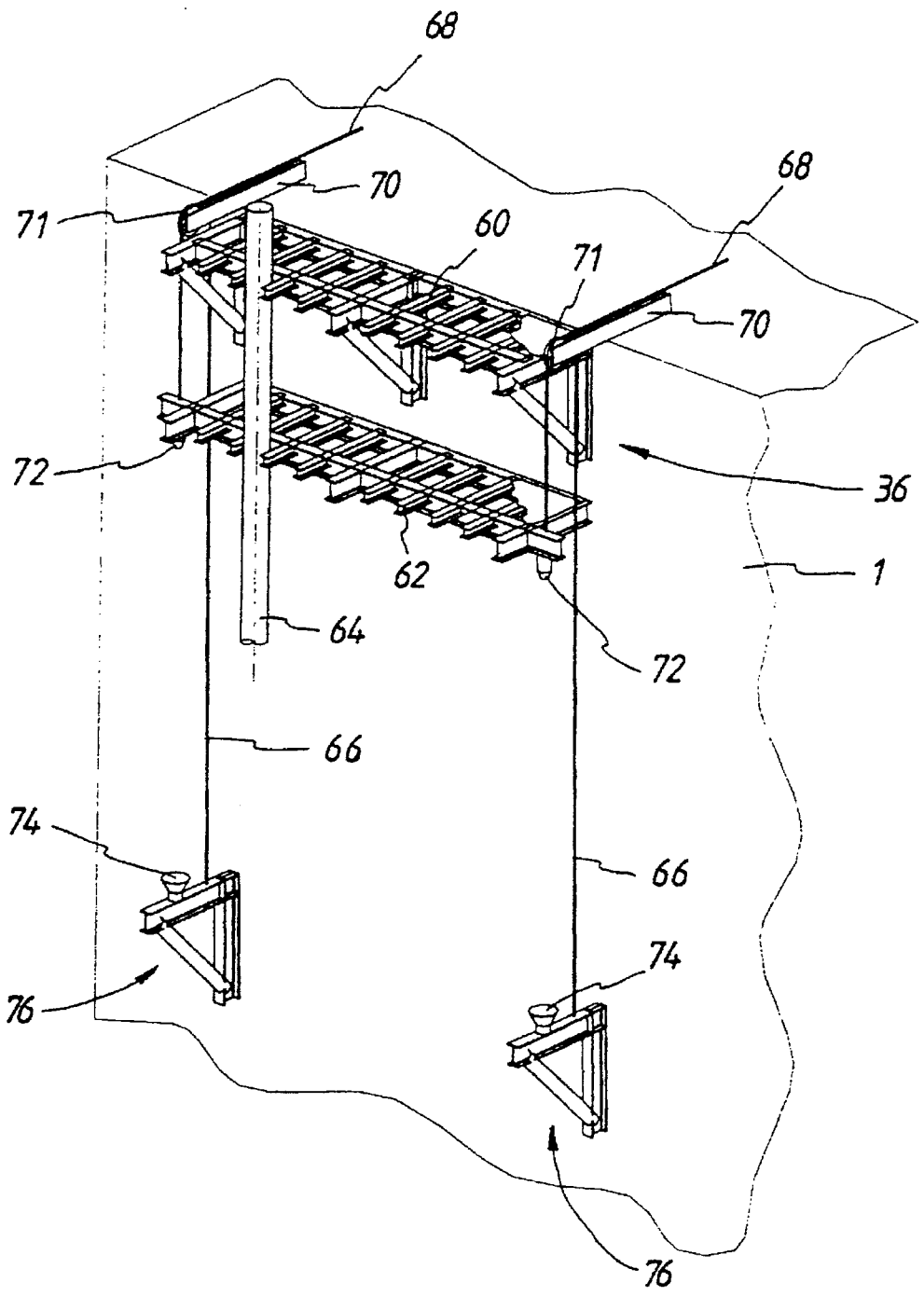
FIG. 10 shows a view in perspective of the device of FIG. 9.

FIGS. 9 and 10 show a rack 36 which is disposed against the rear end of the drilling platform 1. The rack 36 comprises a top set of parallel arms 60 and a bottom set of parallel arms 62. The arms 60 and 62 are placed at such a distance from each other that sub-assemblies 64 of the casing pipes or riser pipes can be fixed between them. The bottom set of arms 62 can be moved in the vertical direction relative to the top set of arms 60 fixed to the rear end of the drilling platform 1 along guide cables 66 by means of hoisting cables 68. The hoisting cables 68 are wound onto winches (not shown in any further detail) and are guided by means of pulleys 71 disposed on one end of arms 70 to the bottom set of arms 62. The frame of which the arms 62 form part is provided at the bottom side with pins 72, which in the bottom position of the frame fall into sockets 74 of stop supports 76.

Figure 11:
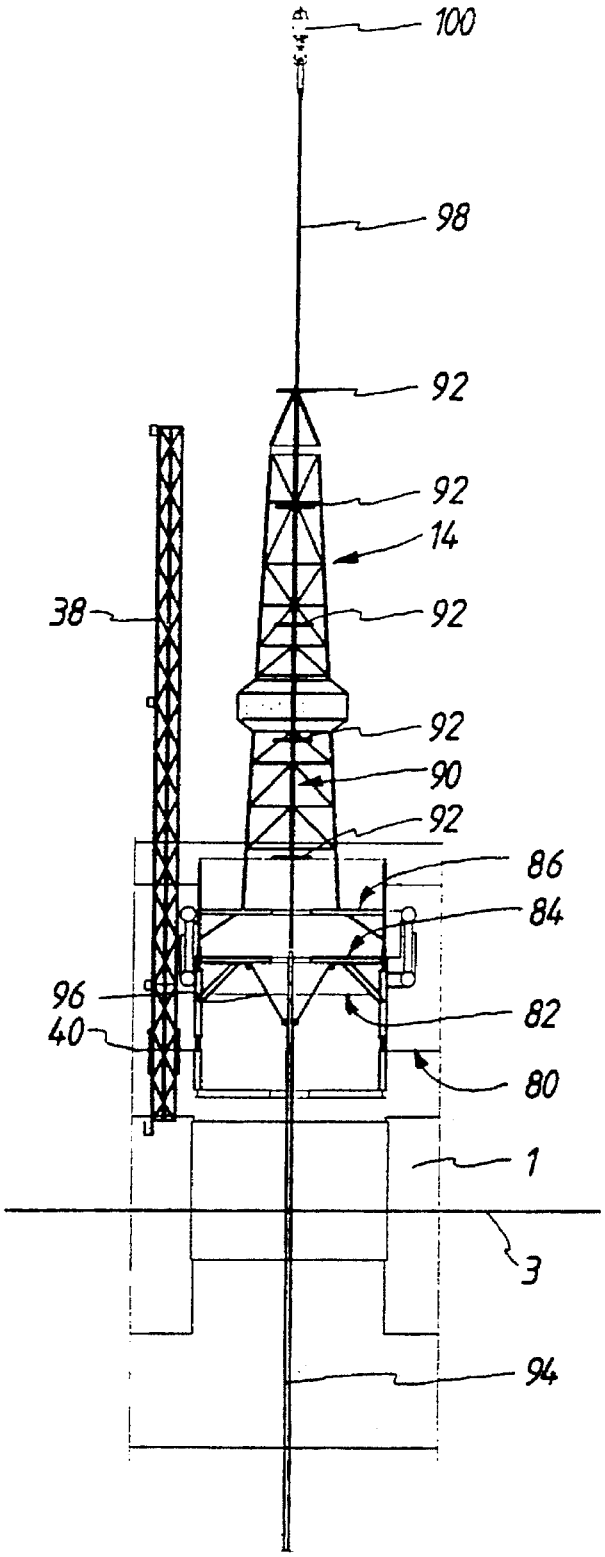
FIG. 11 shows a diagrammatic front view of the drilling derrick of FIG. 1.
Figure 12:
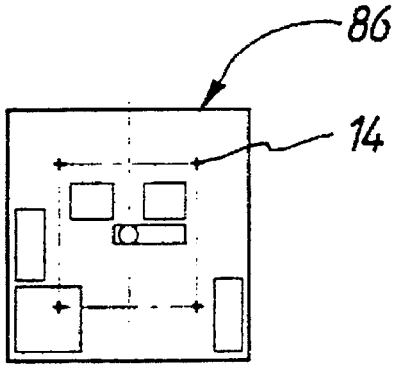
FIG. 12 shows a diagrammatic top view of a derrick floor.
Figure 13:
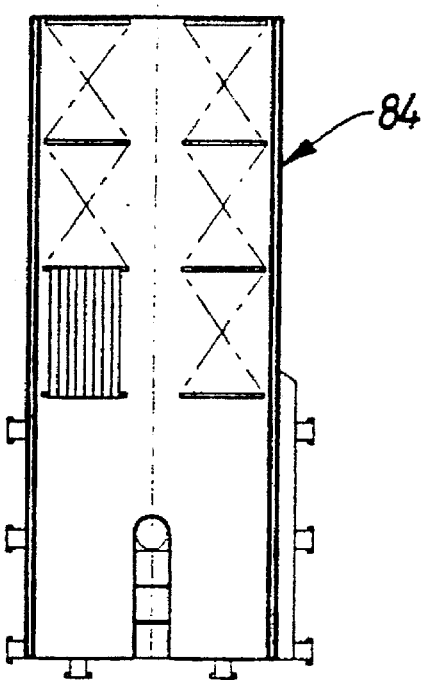
FIG. 13 shows a diagrammatic top view of an auxiliary working floor.

FIGS. 11–13 show the drilling derrick 14 with the corresponding decks and working floors. Above the main deck 80 of the drilling platform 1 is a second deck 82, an auxiliary working floor 84 and a derrick floor 86. The derrick floor 86, on which the derrick 14 is situated, can be moved to the centre of the drilling platform 1, so that the part of the auxiliary working floor 84 lying underneath it is cleared and can be used for interconnecting sub-assemblies of casing pipes or riser pipes. These sub-assemblies can be transferred by means of hoisting crane 2 from a rack 36 or from storage place 26 by means of support 38 to the auxiliary working floor 84 and placed against a supporting structure 90 which is fixed at the side edge of the drilling derrick 14. As can be seen more clearly in FIGS. 1 and 3, the supporting structure 90 comprises a number of essentially V-shaped supports 92, the legs of which face away from the drilling derrick 14.

In particular, FIG. 11 shows the top end of an already positioned riser string 94, which end is fixed by means of clamping means 96 of the auxiliary working floor 84. A sub-assembly 98 for a casing string hangs above the riser string 94 from a hook 100 of the hoisting crane 2. The drilling derrick 14 with the supporting structure 90 fixed thereon is positioned in such a way that the sub-assembly 98 lies essentially in line with the riser string 94 against the supports 92 of the supporting structure 90. The casing sub-assembly 98 can be connected to a part of the casing string already situated in the riser string 94, following which the extended part of the casing string on the hook 100 is lowered into the riser string.

Figure 14:
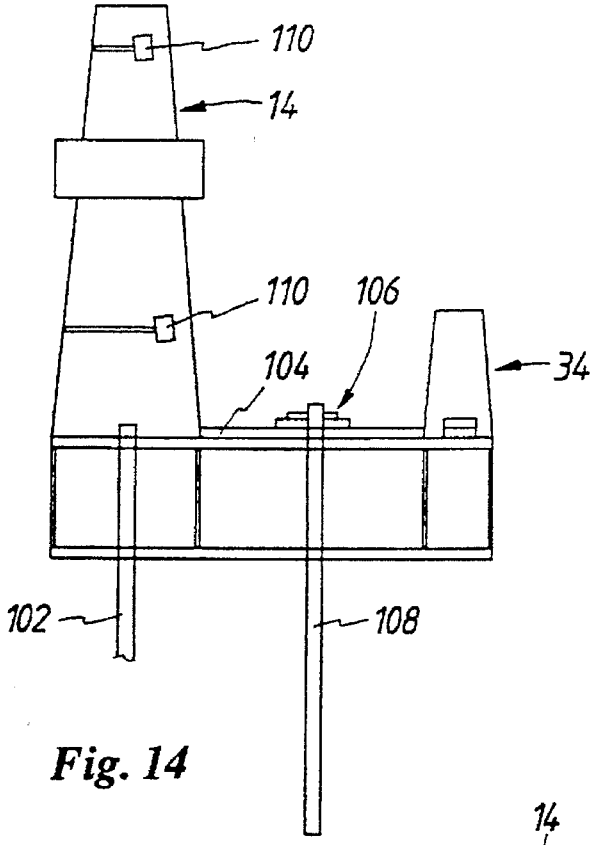
FIG. 14 shows a diagrammatic side view of a part of a drilling rig according to the invention.
Figure 15:
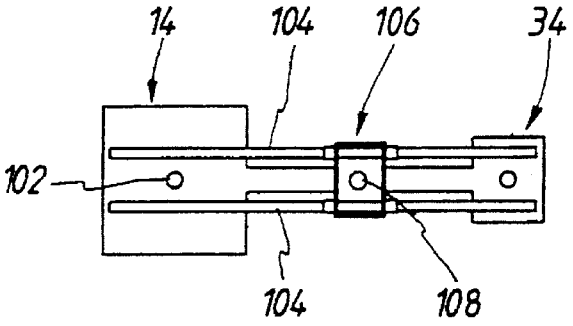
FIG. 15 shows a diagrammatic top view of the device of FIG. 14.

FIGS. 14 and 15 show a drilling derrick 14, at the foot of which the top end of a casing string 102 is fixed. Situated at some distance from the drilling derrick 14 is a sub-assembly pre-assembly installation 34, in which sub-assemblies for the casing string 103 are pre-assembled. A conveyor 106, which moves along rails 104 and is provided with means for fixing a part of a casing sub-assembly 108 is provided between the sub-assembly pre-assembly installation 34 and the drilling derrick 14. A casing sub-assembly 108 can be conveyed by means of the conveyor 106 from the sub-assembly pre-assembly installation 34—after being pre-assembled there—to the drilling derrick 14 next to the top end of the already assembled part of the casing string 102.

Figure 16:
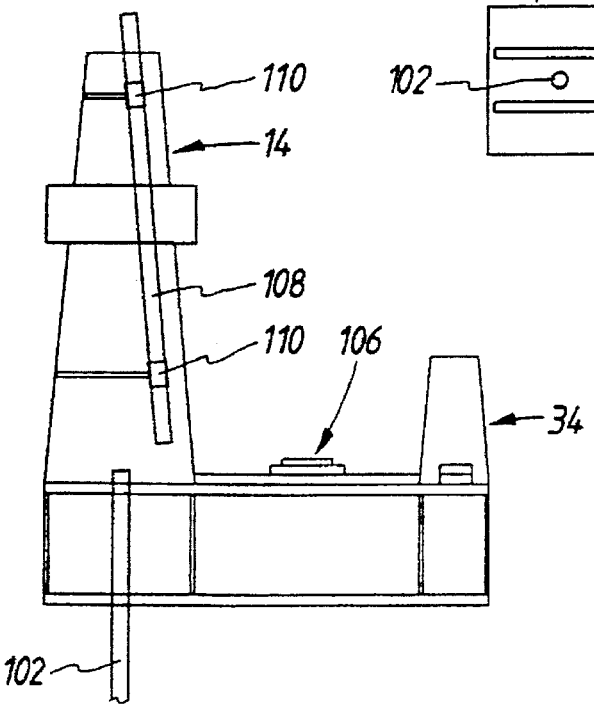
FIG. 16 illustrates the use of the device of FIG. 14.

The drilling derrick 14 is provided with a hoisting arrangement (not shown in any further detail) and guides 110. As FIG. 16 illustrates, the casing sub-assembly 108 is raised at an angle by means of the guides 110 until the bottom end of the sub-assembly 108 is situated at a greater height than the top end of the casing string 102. The casing sub-assembly 108 can then be moved into a position in line with the casing string 102 and connected thereto, following which the hoisting arrangement of the drilling derrick 14 can lower the extended casing string, so that a further casing sub-assembly produced in the sub-assembly pre-assembly installation 34 can be connected to the casing string 102. It can be seen from this that the method according to the invention can also be carried out without the use of hoisting cranes 2 and 4.

Figure 17:
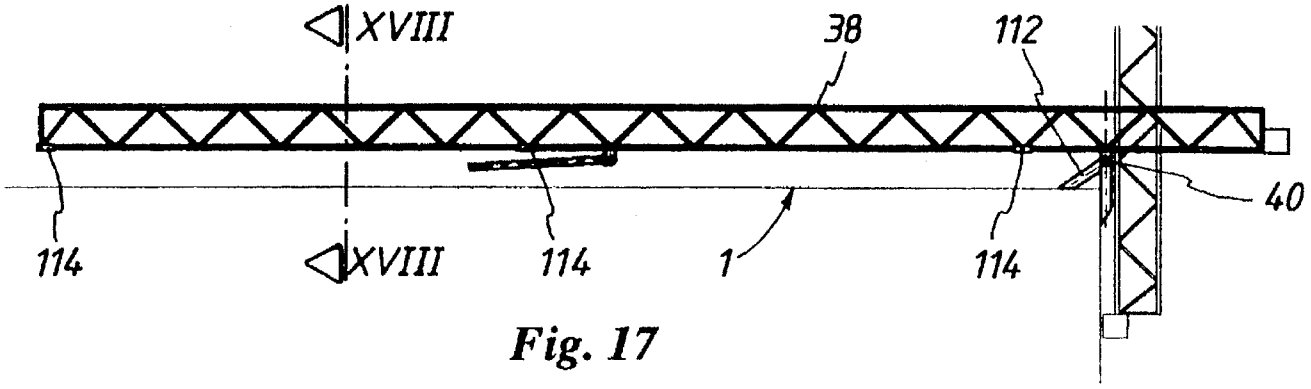
FIG. 17 shows a side view of a tilting support of the drilling rig, on an enlarged scale.
Figure 18:
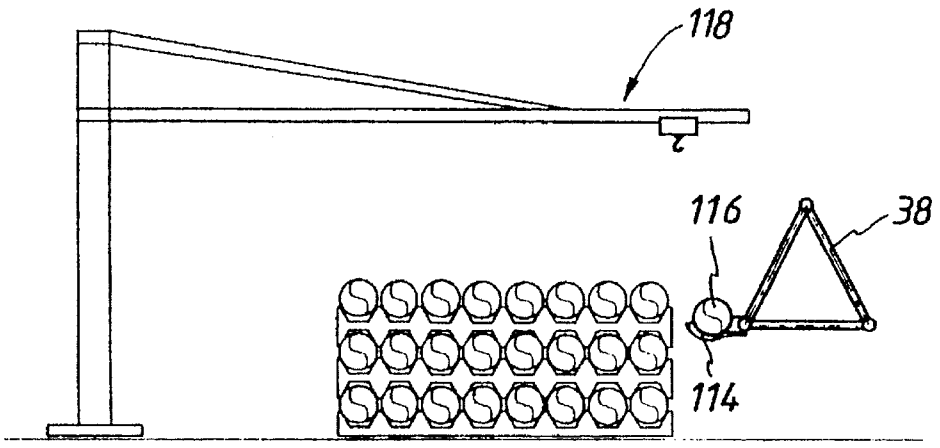
FIG. 18 illustrates a cross-section of the support of FIG. 17 along a plane XVIII—XVIII, on an enlarged scale, and the interaction thereof with conveyor and storage means.

FIGS. 17 and 18 show the support 38 on an enlarged scale. The support 38 is tiltable about an axis 40 of a bearing support 112 mounted on the drilling platform 1, from an essentially horizontal position to an essentially vertical position which is indicated by fine lines, and vice versa, by means of drive means (not shown in any further detail). The support 38 is provided with a number of curved supporting elements 114.

If a riser string has already been placed and weather conditions deteriorate to such an extent that the riser string has to be brought to the surface, sub-assemblies of the riser string are detached from the remaining part of the riser string by means of a hoisting crane, and are then hung against the supporting elements 114 of the support 38 which is vertically oriented, following which the support 38 is tilted to a horizontal orientation and, as FIG. 18 illustrates, the riser sub-assembly 116 is stored temporarily by means of hoisting means 118. When the weather conditions have improved sufficiently again, the riser sub-assemblies are placed in horizontal orientation on the supporting elements 114 of the support 38 by means of the hoisting means 118 and are tilted and re-assembled again to form a complete riser string.

Figure 19:
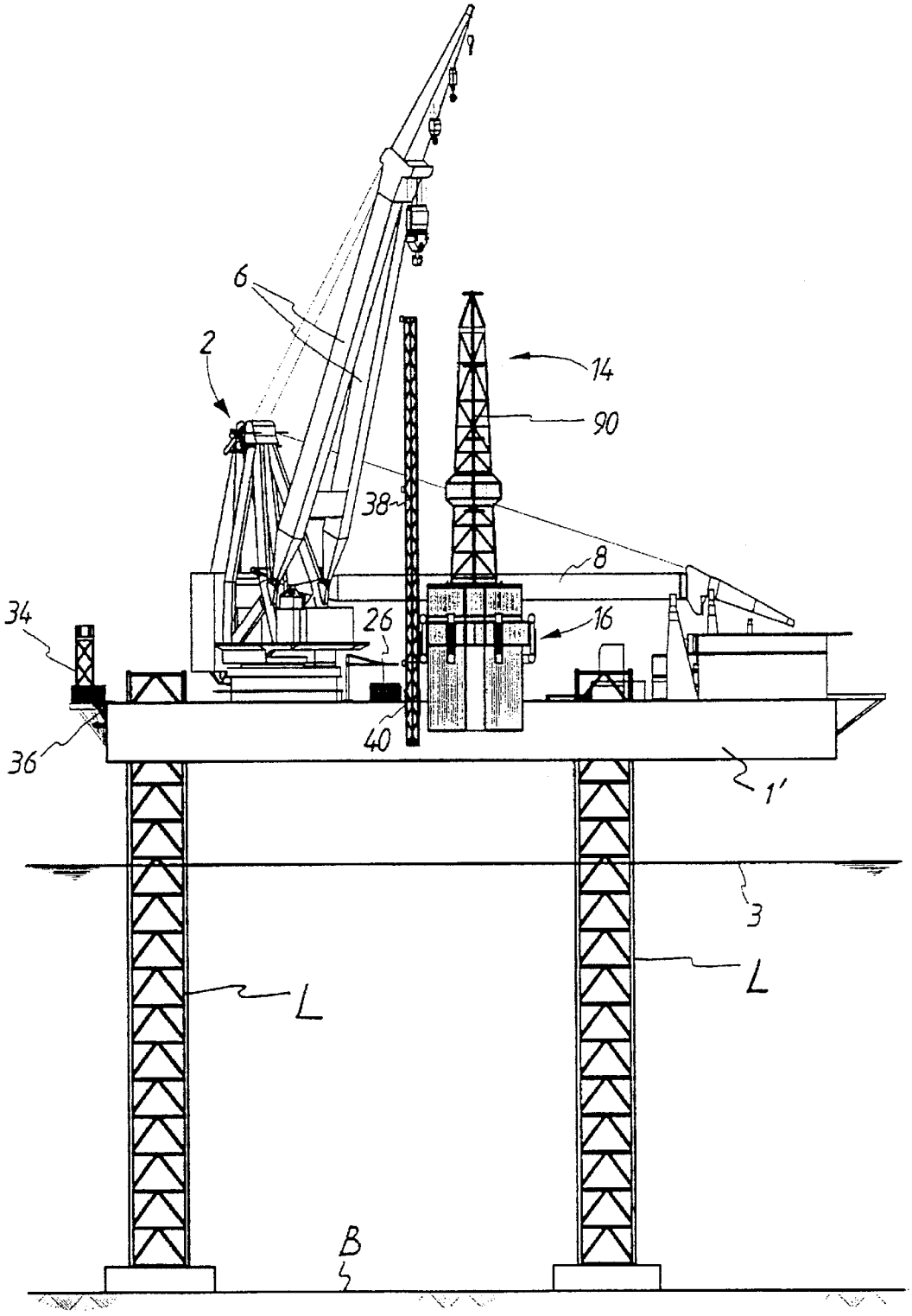
FIG. 19 is a side view of the drilling rig and the drilling platform of FIGS. 1–18 supported on an underwater bed.
Figure 20:
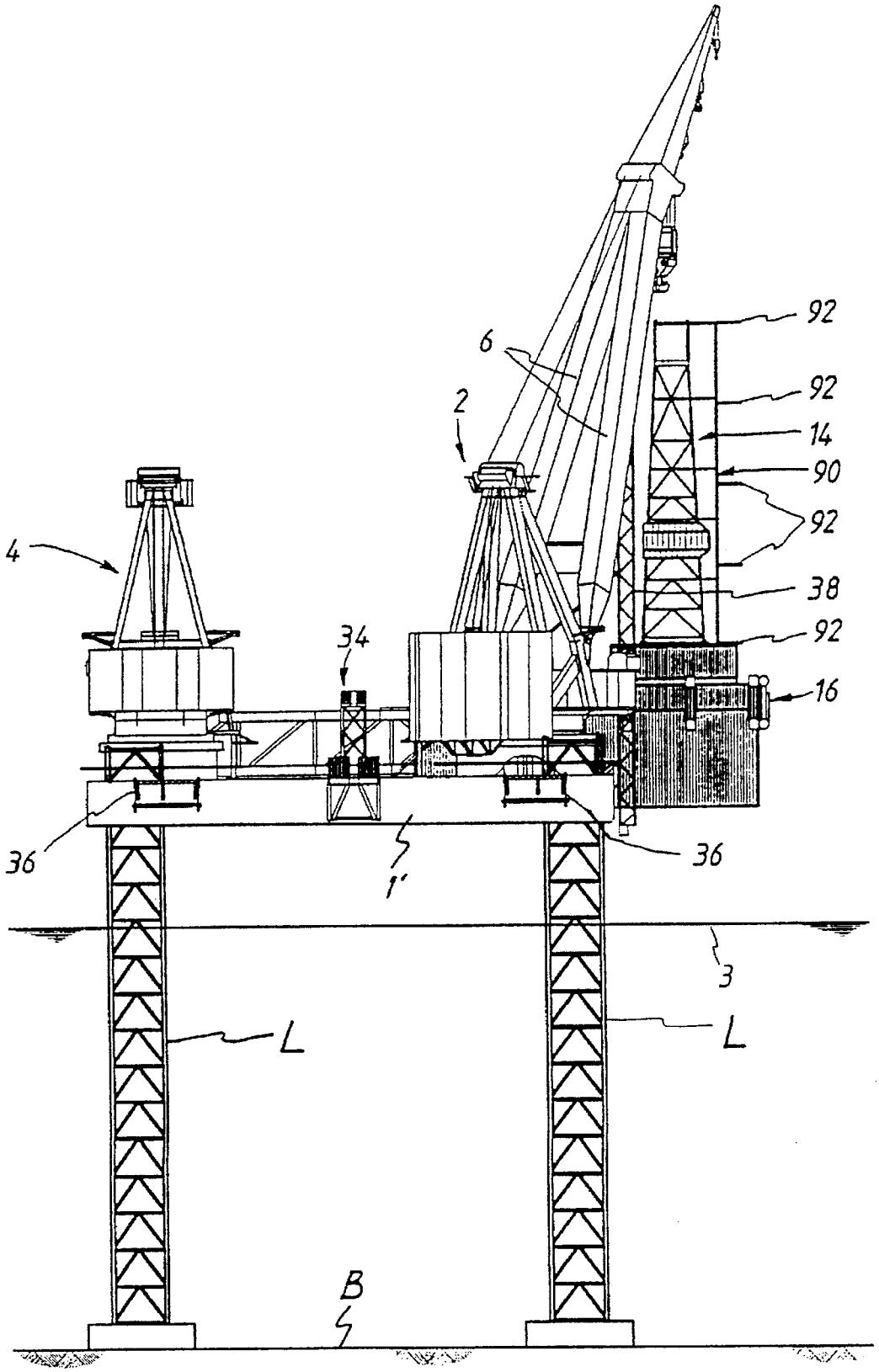
FIG. 20 is a rear view of the drilling rig and the drilling platform of FIG. 19.

Referring now to FIGS. 19 and 20, the drilling platform is shown supported on an underwater bed B by means of legs L rather than floating on the water. In all other respects, the construction and operation of the components described hereinbefore are identical, and like parts bear primed reference numerals.

While the invention has been described and illustrated in its preferred embodiments, it should be understood that departures may be made therefrom within the scope of the invention, which is not limited to the details disclosed herein.

What is claimed is:

1. A method for drilling for oil or gas in an underwater bed by means of a drilling rig disposed on a floating drilling platform or on the underwater bed and having at least one drilling derrick, the method comprising the following steps:

a. assembling a drill string and drilling a borehole in the underwater bed with the drill string by means of the drilling derrick;

b. removing the drill string from the borehole;

c. assembling and placing a casing string in the borehole;

d. repeating steps a., b. and c. at least once for boreholes and casing strings of ever decreasing diameter;

e. assembling a riser string, and placing a riser string after placing of one of the casing strings;

the method further comprising the step of, prior to the placing of a casing string, the placing of a riser string or the drilling of a hole, pre-assembling one or more parts of the casing string, the riser string or the drill string on the drilling rig at one or more pre-assembly points which are in a position which is different from the position of the at least one drilling derrick; and conveying to the drilling derrick each part of the casing string, riser string or drill string from the pre-assembly points to means for assembling the casing string, riser string or drill string and placing the casing string in the borehole, placing the riser string in the borehole or drilling a borehole.

2. A method according to claim 1, wherein, prior to the placing of a casing string or a riser string, a certain number of the pipes from which the above are assembled are interconnected at a pre-assembly point to form a sub-assembly, and subsequently when the casing string or the riser string is being placed the sub-assembly is connected to one or more other pre-assembled sub-assemblies or pipes of a casing string or riser string.

3. A method according to claim 1, wherein a bottom-hole assembly is pre-assembled at a pre-assembly point prior to the drilling of a hole, and the bottom-hole assembly is subsequently connected to pipes of the drill string for drilling of the hole.

4. A method according to claim 2, wherein sub-assemblies for a casing string are pre-assembled during the drilling of a borehole.

5. A method according to claim 2, wherein sub-assemblies for a casing string are pre-assembled during the placing of a riser string on the borehole.

6. A method according to claim 2, wherein sub-assemblies for a riser string are pre-assembled during the drilling of a borehole.

7. A method according to claim 2, wherein sub-assemblies for a riser string are pre-assembled during the placing of a casing string in the borehole.

8. A method according to claim 3, wherein the bottom-hole assembly for a drill string is pre-assembled during the placing of a casing string or a riser string.

9. A method according to claim 2, wherein a sub-assembly for a casing string comprises at least 3 and at most 10 casing pipes.

10. A method according to claim 2, 6 or 7, wherein a sub-assembly for a riser string comprises at least 3 and at most so many riser pipes that the length of the sub-assembly is 90% or more of the desired final length of the riser string.

11. A method according to claim 2, wherein the sub-assemblies for a casing string or a riser string are pre-assembled in vertical orientation at the pre-assembly point.

12. A method according to claim 11, wherein the sub-assemblies for a casing string or a riser string are stored in vertical orientation after pre-assembling and prior to assembling and placing of the casing string or the riser string.

13. A method according to claim 12, wherein the sub-assemblies are supported in their lengthwise direction at least at two places in a rack.

14. A method according to claim 1, wherein for the temporary removal of a riser string which has been installed it is divided into sub-assemblies, each consisting of a number of riser pipes, which sub-assemblies are tilted to a horizontal orientation for the storage thereof on the drilling rig.

15. A drilling rig for drilling for oil or gas in an underwater bed, disposed on a floating drilling platform or on the underwater bed, comprising;

at least one drilling derrick;

means on the drilling derrick for assembling a drill string and drilling a borehole in the bed;

means for assembling and placing a casing string in the borehole; and means for assembling and placing a riser string on the borehole;

the drilling rig further comprising:

one or more pre-assembly installations which are situated in a place which is different from that of the at least one drilling derrick, for the pre-assembly of one or more parts of a casing, riser or drill string; and conveyor means for conveying to the drilling derrick each part of a casing, riser or drill string from each pre-assembly installation to the means for assembling the casing, riser or drill string and placing the casing string in the borehole, placing the riser string on the borehole or drilling a borehole.

16. A drilling rig according to claim 15, comprising:

one or more sub-assembly pre-assembly installations for interconnecting a certain number of casing pipes or riser pipes to form a sub-assembly;

sub-assembly storage means for storing the sub-assembly; and means for connecting the sub-assembly to one or more other pre-assembled sub-assemblies or pipes of a casing string or riser string, and placing of the casing string in the borehole or placing the riser string on the borehole.

17. A drilling rig according to claim 15, comprising:

a pre-assembly installation for pre-assembling a bottom-hole assembly of a drill string; and means for connecting the bottom-hole assembly to pipes of the drill string.

18. A drilling rig according to claim 16, wherein the sub-assembly storage means comprise one or more racks disposed at a side of the drilling rig, in which racks the sub-assemblies can be fixed in vertical orientation and at least at two different places.

19. A drilling rig according to claim 18, wherein the rack comprises two sets of arms situated above one another, the bottom set of arms being movable in the vertical direction relative to the top set of arms.

20. A drilling rig according to claim 15, wherein the conveyor means consist of a hoisting crane.

21. A drilling rig according to claim 15, wherein the conveyor means consist of a conveyor which is movable along guide rails and is provided with means for fixing a part of a casing, riser or drill string.

22. A drilling rig according to claim 16, wherein the means for connecting a sub-assembly to one or more other pre-assembled sub-assemblies or pipes of a casing string or riser string comprise a supporting structure disposed at a side of the at least one drilling derrick, the latter being movable sideways for placing of the supporting structure above an auxiliary working floor, which auxiliary working floor is provided with casing pipe and/or riser pipe connection means.

23. A drilling rig according to claim 22, wherein the supporting structure comprises a number of V-shaped supports each extending in a horizontal plane above one another, the two legs of which face away from the at least one drilling derrick, for the purpose of supporting a sub-assembly at different levels at two sides.

24. A drilling rig according to claim 16, wherein a support which can tilt from a vertical orientation to a horizontal orientation and vice versa is provided for tilting and storing casing and/or riser sub-assemblies.

* * * * *